US008123077B2

(12) United States Patent
Orlowski et al.

(10) Patent No.: US 8,123,077 B2
(45) Date of Patent: Feb. 28, 2012

(54) FLOATING SQUIRTING TOY

(75) Inventors: Boguslaw Orlowski, Oceanside, CA (US); Veronica Wong, Hong Kong (HK); Francis Chia, Hong Kong (HK)

(73) Assignee: Easebon Services Limited, Kwun Tong (HK)

( * ) Notice: Subject to any disclaimer, the term of this patent is extended or adjusted under 35 U.S.C. 154(b) by 0 days.

(21) Appl. No.: 12/018,691

(22) Filed: Jan. 23, 2008

(65) Prior Publication Data

US 2008/0121652 A1 May 29, 2008

Related U.S. Application Data

(63) Continuation-in-part of application No. 11/860,617, filed on Sep. 25, 2007, now Pat. No. 7,571,837, which is a continuation of application No. 10/942,326, filed on Sep. 16, 2004, now Pat. No. 7,281,642.

(51) Int. Cl.
*A63H 3/18* (2006.01)

(52) U.S. Cl. ..... 222/79; 446/153

(58) Field of Classification Search ..... 222/79, 222/366, 212, 409, 386, 518, 513, 511; 446/153, 446/473, 476; 92/246, 245; 239/394
See application file for complete search history.

(56) References Cited

U.S. PATENT DOCUMENTS

| | | | | |
|---|---|---|---|---|
| 213,050 | A | | 3/1879 | Lewis |
| 26,839 | A | | 3/1897 | Lines |
| 1,031,526 | A | | 7/1912 | Cloud, Jr. |
| 1,394,456 | A | | 10/1921 | Wanat |
| D60,050 | S | | 12/1921 | Vernie H. Mohler |
| 2,573,375 | A | | 10/1951 | Winstead |
| 3,299,891 | A | * | 1/1967 | Smeton ..... 604/232 |
| D225,755 | S | | 1/1973 | Hale |
| 3,884,229 | A | * | 5/1975 | Raines et al. ..... 604/205 |
| D240,130 | S | | 6/1976 | Folke |
| 4,193,517 | A | | 3/1980 | Fetty et al. |
| 4,274,223 | A | | 6/1981 | Morrison et al. |
| D262,079 | S | | 12/1981 | Rankin |
| 4,383,387 | A | | 5/1983 | Puskar |
| 4,548,190 | A | | 10/1985 | Megargee |

(Continued)

FOREIGN PATENT DOCUMENTS

| | | | | |
|---|---|---|---|---|
| GB | 2045097 | * | 0/1908 | ..... 222/79 |

(Continued)

OTHER PUBLICATIONS

World Intellectual Property Organization, International Search Report, May 8, 2007.

(Continued)

*Primary Examiner* — Lien Ngo
(74) *Attorney, Agent, or Firm* — Amster, Rothstein & Ebenstein LLP

(57) ABSTRACT

A squirting toy is comprised of a cylindrical housing and a piston that slides within to force water into or out of the housing via a hole therein. The housing is encased within a shell creating a water impervious volume sufficient for the toy to float in water. The shell is soft, so that the gun is not a safety hazard when left floating in a swimming pool. Handles associated with one or both actuating portions of the squirting toy are provided for gripping and operating the squirting toy more effectively.

23 Claims, 8 Drawing Sheets

U.S. PATENT DOCUMENTS

| | | | | | |
|---|---|---|---|---|---|
| 4,597,527 | A | | 7/1986 | Sands | |
| 4,615,488 | A | | 10/1986 | Sands | |
| 4,627,796 | A | | 12/1986 | Moore | |
| 4,673,007 | A | | 6/1987 | Huang | |
| 4,733,799 | A | * | 3/1988 | Wiskur | 222/79 |
| 4,796,785 | A | | 1/1989 | Merritt | |
| 4,809,483 | A | | 3/1989 | Lovik | |
| 4,919,600 | A | | 4/1990 | Yang | |
| 4,963,847 | A | | 10/1990 | Cambreleng et al. | |
| D315,095 | S | | 3/1991 | Wright | |
| 5,009,413 | A | | 4/1991 | Allen | |
| D320,469 | S | | 10/1991 | Hoenig | |
| 5,061,252 | A | * | 10/1991 | Dragosits | 604/218 |
| 5,120,261 | A | | 6/1992 | Dietzman | |
| D328,248 | S | | 7/1992 | Ruff | |
| 5,181,644 | A | | 1/1993 | Ferrel | |
| 5,199,114 | A | | 4/1993 | Christopher | |
| D336,354 | S | | 6/1993 | Ringe | |
| D336,668 | S | | 6/1993 | D'Andrade | |
| D337,354 | S | | 7/1993 | Childs | |
| 5,224,633 | A | | 7/1993 | Senart | |
| D338,697 | S | | 8/1993 | Salmon et al. | |
| 5,231,951 | A | | 8/1993 | Tagar et al. | |
| D339,616 | S | | 9/1993 | Flaherty | |
| 5,255,708 | A | | 10/1993 | Liparoto et al. | |
| 5,256,099 | A | * | 10/1993 | Rudell et al. | 446/473 |
| 5,266,069 | A | | 11/1993 | Thorne | |
| D344,311 | S | | 2/1994 | Liu | |
| D344,556 | S | | 2/1994 | Liu | |
| 5,305,918 | A | | 4/1994 | D'Andrade | |
| D351,007 | S | | 9/1994 | Bednar et al. | |
| 5,350,058 | A | | 9/1994 | Keough | |
| D352,093 | S | | 11/1994 | Knycha | |
| D354,093 | S | | 1/1995 | Hamlin | |
| 5,389,033 | A | | 2/1995 | Rauch | |
| D357,886 | S | | 5/1995 | Fuller | |
| D358,185 | S | | 5/1995 | Hope, II | |
| D360,439 | S | | 7/1995 | Lewinski | |
| D361,105 | S | | 8/1995 | Griffin | |
| D362,801 | S | | 10/1995 | Milroy | |
| D368,280 | S | | 3/1996 | Brown | |
| 5,499,858 | A | | 3/1996 | Her | |
| 5,605,485 | A | * | 2/1997 | Spector | 446/72 |
| 5,609,507 | A | * | 3/1997 | Spector | 446/72 |
| 5,667,419 | A | * | 9/1997 | Spector | 446/72 |
| 5,683,250 | A | | 11/1997 | Paivanas | |
| 5,788,617 | A | | 8/1998 | Paris | |
| 5,865,438 | A | | 2/1999 | Zilliox | |
| 5,928,053 | A | | 7/1999 | Henderson | |
| 5,988,442 | A | | 11/1999 | Corey et al. | |
| 5,992,697 | A | * | 11/1999 | James | 222/175 |
| 6,027,393 | A | * | 2/2000 | O'Rourke | 446/153 |
| 6,039,460 | A | | 3/2000 | Ng et al. | |
| D424,932 | S | | 5/2000 | Seidler | |
| D446,122 | S | | 8/2001 | Weinstein et al. | |
| D449,982 | S | | 11/2001 | Ferris | |
| 6,474,858 | B1 | | 11/2002 | Liao | |
| D470,761 | S | | 2/2003 | Kelvie | |
| 6,568,985 | B1 | | 5/2003 | Binkley | |
| 6,638,172 | B1 | | 10/2003 | Demars | |
| D481,770 | S | | 11/2003 | Choy | |
| 6,722,679 | B2 | | 4/2004 | Englert | |
| D494,856 | S | | 8/2004 | Hillard | |
| 6,790,112 | B2 | | 9/2004 | Kirk | |
| 6,808,436 | B1 | | 10/2004 | Siu | |
| 6,843,695 | B1 | | 1/2005 | Jackson et al. | |
| 0,514,633 | A1 | | 2/2006 | Yu Zheng | |
| 6,997,770 | B2 | | 2/2006 | Lapointe | |
| D517,411 | S | | 3/2006 | Okimoto | |
| 7,025,228 | B2 | | 4/2006 | Cuisinier | |
| D524,881 | S | | 7/2006 | Orlowski et al. | |
| D528,914 | S | | 9/2006 | Williams | |
| D536,040 | S | | 1/2007 | Orr et al. | |
| 7,264,522 | B2 | | 9/2007 | Lee et al. | |
| 7,281,642 | B2 | | 10/2007 | Orlowski | |
| D557,356 | S | | 12/2007 | Johnston et al. | |
| D557,357 | S | | 12/2007 | Johnston et al. | |
| D558,278 | S | | 12/2007 | Johnston et al. | |
| D558,279 | S | | 12/2007 | Chen | |
| D564,854 | S | | 3/2008 | Thompson | |
| D570,687 | S | | 6/2008 | Kelders et al. | |
| D574,443 | S | | 8/2008 | Wong | |
| D590,027 | S | | 4/2009 | Chia | |
| D606,130 | S | | 12/2009 | Wong | |
| D621,449 | S | | 8/2010 | Wong | |
| D621,450 | S | | 8/2010 | Wong | |
| D621,451 | S | | 8/2010 | Wong | |
| D621,452 | S | | 8/2010 | Wong | |
| 7,913,880 | B2 | | 3/2011 | Chia | |
| 2003/0071077 | A1 | | 4/2003 | Panzarella | |
| 2003/0124922 | A1 | | 7/2003 | Sowry et al. | |
| 2004/0245285 | A1 | * | 12/2004 | McLaughlin | 222/78 |
| 2005/0106963 | A1 | | 5/2005 | Ross | |
| 2005/0184098 | A1 | | 8/2005 | Dixon | |
| 2005/0196287 | A1 | * | 9/2005 | Olich | 417/119 |
| 2006/0027596 | A1 | | 2/2006 | Walther et al. | |
| 2007/0000942 | A1 | | 1/2007 | Wong et al. | |
| 2008/0035680 | A1 | | 2/2008 | Orlowski | |
| 2008/0051002 | A1 | | 2/2008 | Chung Wong | |
| 2008/0054019 | A1 | | 3/2008 | Stechschulte et al. | |
| 2008/0121652 | A1 | | 5/2008 | Orlowski et al. | |

FOREIGN PATENT DOCUMENTS

| | | |
|---|---|---|
| GB | 2045097 | 10/1980 |

OTHER PUBLICATIONS

European Patent Office, Supplementary European Search Report, Feb. 19, 2008.

Document produced by Defendant in *Prime Time Toys, Ltd.* v. *Jakks Pacific, Inc.*, No. 08-CV-2909 (S.D.N.Y. 2008).

U.S. Appl. No. 13/053,608, Filed Mar. 22, 2011 Francis See Chong Chia, Squirting Toy Including A Supplemental Reservoir System and Methods Thereof.

U.S. Appl. No. 13/295,281, Filed Nov. 14, 2011, Boguslaw Orlowski, Floating Squirting Toy.

U.S. Appl. No. 29/302,703, Filed Jan. 23, 2008, Francis Chia, Face for Squirting Toy Handle, Abandoned Feb. 27, 2009.

U.S. Appl. No. 29/302,709, Filed Jan. 23, 2008, Boguslaw Orlowski, Shell for Squirting Toy, Abandoned Feb. 27, 2009.

* cited by examiner

FLOATING SQUIRTING TOY

CROSS REFERENCE TO RELATED APPLICATION

This application is a continuation-in-part of U.S. patent application Ser. No. 11/860,617 filed on Sep. 25, 2007, now U.S. Pat. No. 7,571,837, the contents of which are incorporated herein in their entirety by reference, which application is a continuation of U.S. application Ser. No. 10/942,326, filed Sep. 16, 2004, now U.S. Pat. No. 7,281,642, the contents of which are incorporated herein by reference in their entirety, for which priority is claimed under 35 U.S.C. §120.

FIELD OF THE INVENTION

The present invention is a water squirting apparatus for use at play. More specifically, it is a soft floating tubular piston type squirt gun for use such as in a swimming pool or swimming area by participants in or adjacent to the water.

BACKGROUND AND OBJECTS OF THE INVENTION

Squirt guns are well known in many forms in the prior art. Numerous squirt guns and squirting toys are made and have been made over the years for use by persons while swimming in or standing adjacent to a swimming pool, which are adapted to quickly take in water from the swimming pool for squirting. One such toy is called Water Stix™ and is sold by Hearthsong Inc. This toy, representative of many such squirting toys, is basically comprised of a housing having a nozzle at its squirting end. A piston, which includes a graspable handle, is adapted to slide within the housing so that, when the nozzle end of the housing is submerged in the pool and the piston is pulled backwards, water is drawn into the housing through the nozzle. And when the piston is subsequently forced forwardly, that water is forced from the housing, through the nozzle, towards a target, in a powerful stream.

Additionally, many squirt guns of the prior art are constructed in a manner that entraps air and thereby inadvertently enables those guns to partially float in water. The degree of such buoyancy is relative to the amount of water that has been taken into the gun and the longevity of such buoyancy is relative to the to the amount of air leakage from the housing.

There are also floating toy "swimming noodles" in the prior art, which are made of resilient floating closed-cell polymer foam. These toys are used to provide buoyancy to the user while swimming. Because these toys are often left floating in the pool when not in use, their softness eliminates the safety threat that they would otherwise pose.

It is therefore an object of the present invention to provide an improved squirting toy that floats fully atop the surface of the water, whether filled with or empty of water.

It is a further object to provide a soft squirting toy that is safer that squirting toys of the prior art.

It is a further object to provide a squirting toy that is both buoyant and soft.

It is a further object to provide such a squirting toy that has a similar appearance to a "swimming noodle".

In a preferred embodiment, the floating, squirting toy comprises a housing having a chamber, the chamber having a variable volume defined by a first chamber end, a second chamber end and a interior surface, a hole through the housing adjacent the first chamber end allows communication between the chamber and the outside environment; a piston disposed adjacent the second chamber end, the piston being sealingly engaged with the chamber interior surface and adapted for longitudinal movement within the housing to vary the volume of the chamber; a shaft attached to the piston and having a portion extending out of the housing, the shaft portion extending out of the housing having a first handle attached thereto; an outer shell disposed over the housing, the shell creating a water impervious volume imparting a buoyancy sufficient to keep the toy afloat in water; and a second handle attached to one of either the shell or the housing. The toy is adapted to inhale water through the hole while the hole is submerged during the expansion of the chamber using the handles, and the toy being adapted to exhale the water through the hole during the contraction of the chamber using the handles. The outer shell may be chosen from one of a transparent, translucent material or a polymeric foam. The cross-sectional shape over a substantial portion of the outer shell may be chosen from at least one of round, polygonal, elliptical, oval, fanciful animal-like and some combination of shapes including generally polygonal with rounded sides.

Further objects and advantages of the invention will be apparent upon a review of the following description and drawings of the invention, including the preferred embodiment thereof.

SUMMARY OF THE INVENTION

The present invention comprises a squirting toy that is housed within a polyethylene (PE) closed cell foam shell. The closed cell shell is non-absorbing, so that the foam remains buoyant and keeps the gun afloat indefinitely. The foam is soft, so that the toy is not a safety hazard when left floating in a swimming pool. In the preferred embodiment, the squirting toy is comprised of a cylindrical housing and a piston that slides within to force water into or out of the housing via a hole therein. The foam shell of the preferred embodiment is similar in size and shape to a "swimming noodle", and is therefore more attractive to a child who is familiar with such. The present invention also encompasses a shell of a shapes dissimilar to traditional "swimming noodles". What is important is that there is sufficient material in the shell to provide buoyancy, i.e. the toy to floats when it is filled with water, and that the shell is soft, i.e. does not present a safety hazard when floating in the water.

A more complete understanding of the invention will be realized upon review of the following description and drawings of preferred embodiments of the invention.

BRIEF DESCRIPTION OF THE DRAWINGS

FIG. 1 is an action view of a squirting toy showing water being expelled there-from;

DETAILED DESCRIPTION OF THE PREFERRED EMBODIMENT

A preferred embodiment of the invention is shown in FIGS. 1 through 5, where there is depicted a toy 100 for squirting a water stream 102, and which is adapted to float on the water surface 104.

Figure 1:
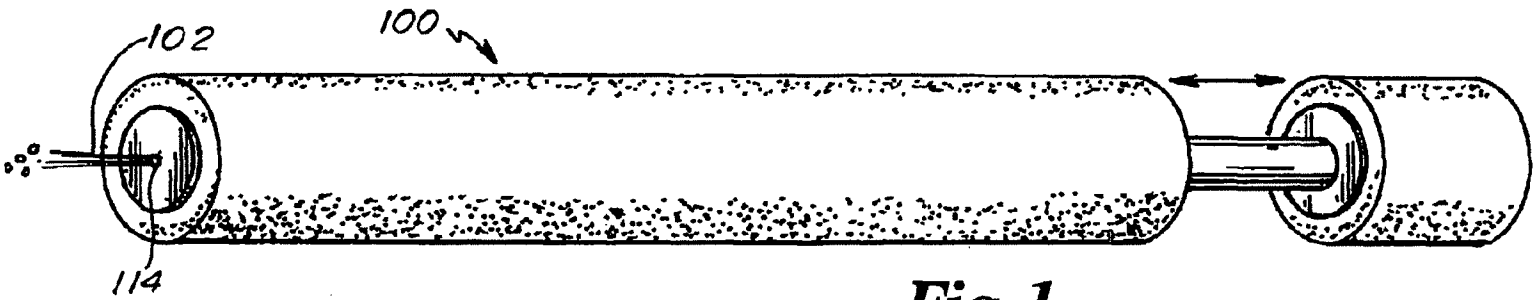
Figure 2:
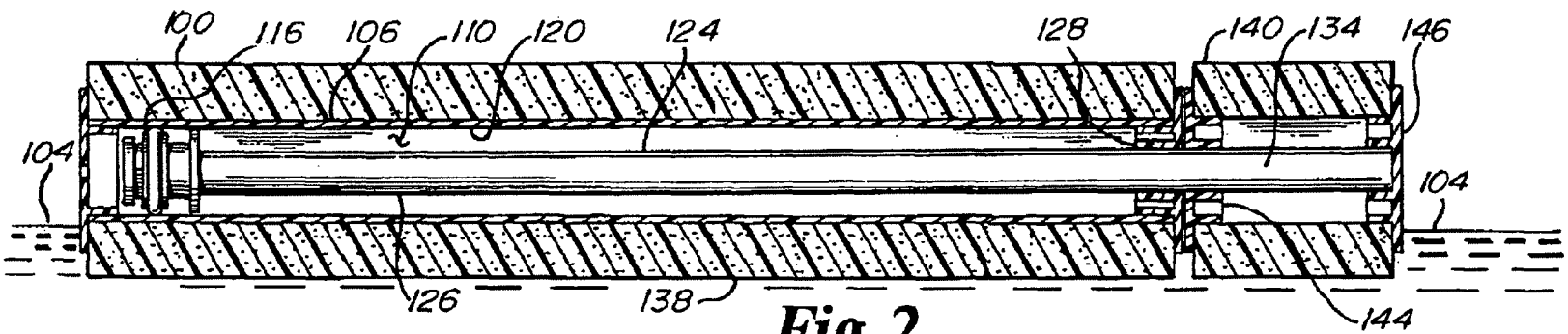
FIG. 2 is a cross-sectional view through the toy of FIG. 1 in its retracted/empty state.
Figure 3:
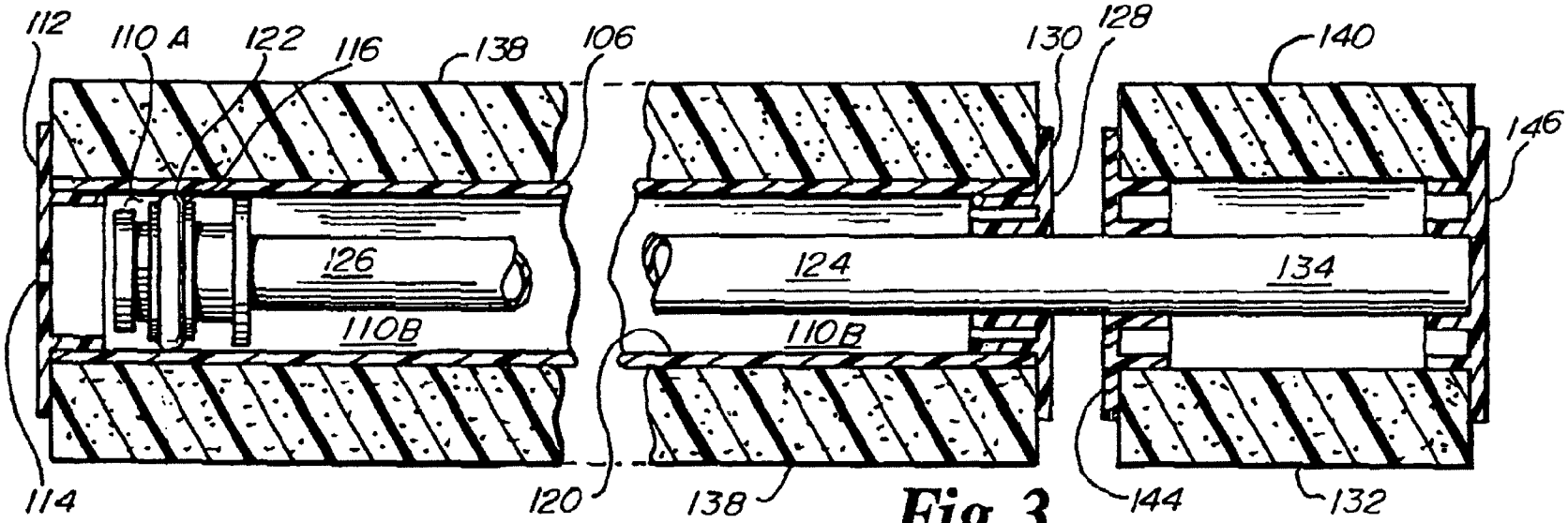
FIG. 3 is an enlarged partial section of the toy of FIG. 1.
Figure 4:
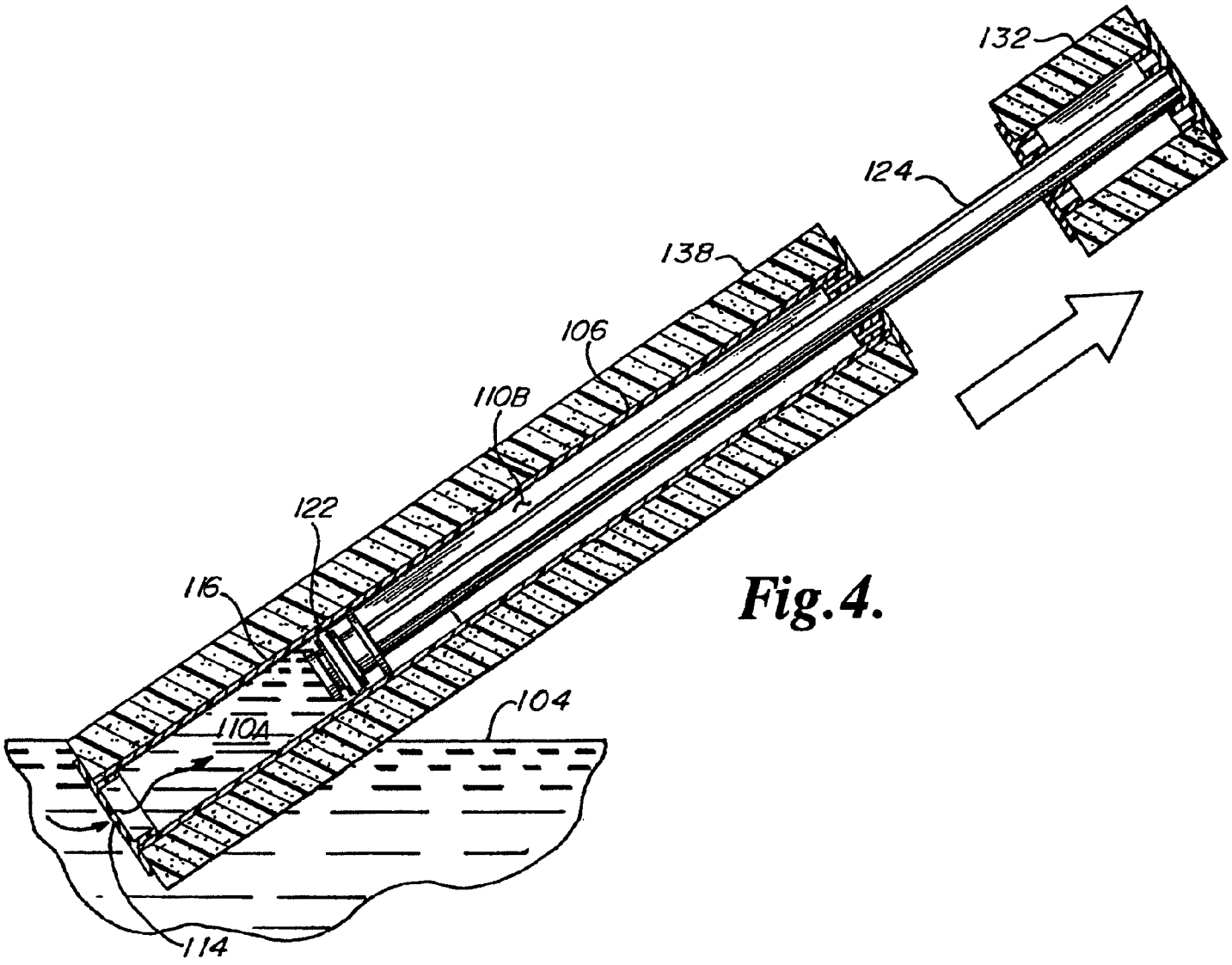
FIG. 4 is an action cross-sectional view showing the intake of water into the toy of FIG. 1.
Figure 5:
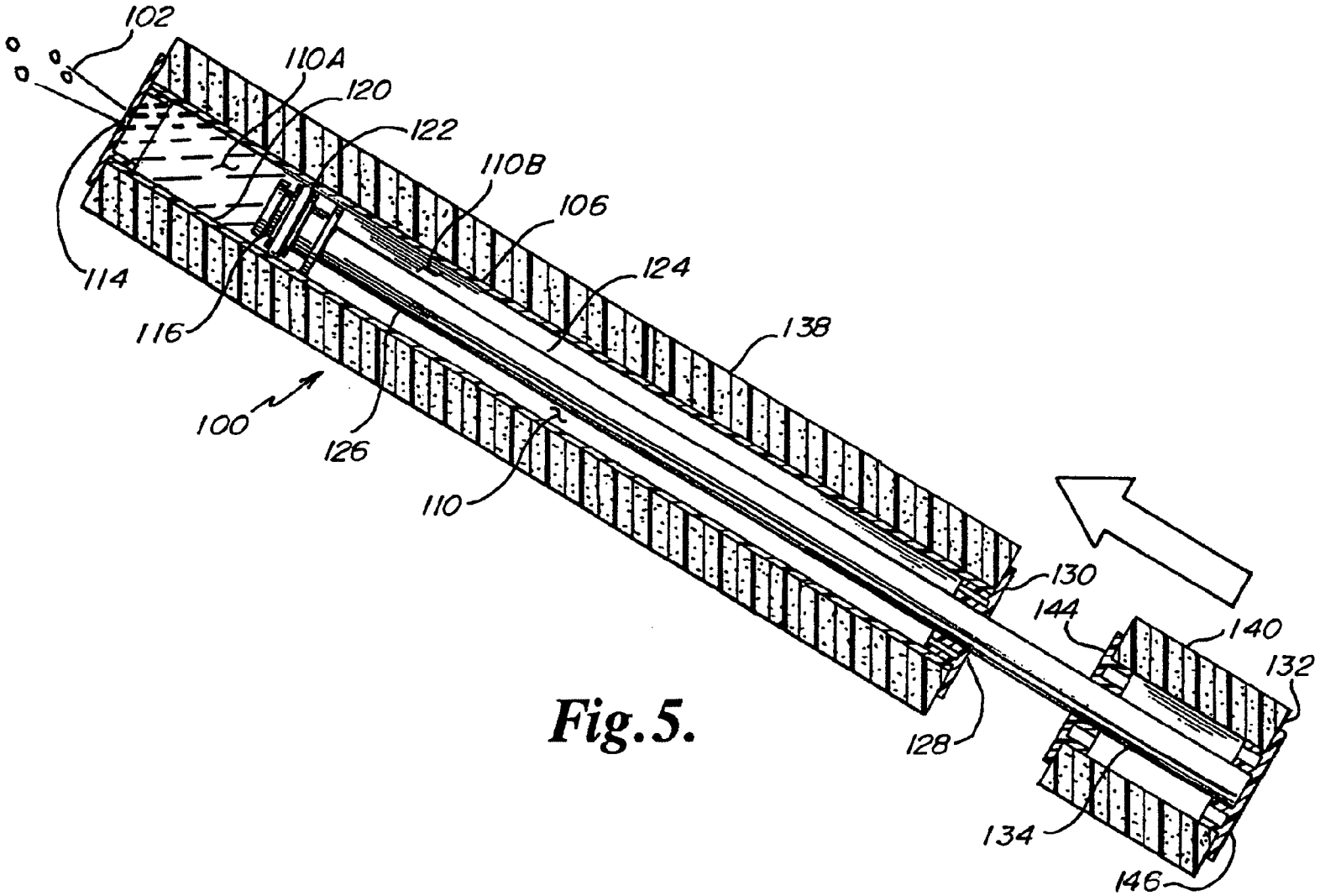
FIG. 5 is an action cross-sectional view showing the expulsion of water from the toy of FIG. 1.

The toy 100 comprises a rigid tubular housing 106 that encloses a hollow cylindrical chamber 110. The forward end 112 of the tubular housing is closed except for a small hole 114. Piston 116 slides longitudinally within chamber 110 and is sealed against the cylindrical inner surface 120 of the chamber by o-ring 122, which is seated within groove 125 of the piston. The piston separates the chamber 110 into a forward portion 110A and a rear portion 110B. The piston 116 is rigidly connected to shaft 124 at the forward end 126 thereof. Slide bushing 128 supports shaft 124 at the rear end 130 of the tubular housing 106, while allowing longitudinal movement relative thereto. Handle portion 132 is rigidly connected to shaft 124 at the rearward end 134 thereof. Expansion of the handle portion 132 relative to the tubular housing 106, while hole 114 is below the water surface 104, as depicted in FIG. 4, causes water to be inhaled into the expanding forward chamber portion 110A, through hole 114. Subsequent retraction of the handle portion 132 relative to the tubular housing 106 causes that water to be exhaled through hole 114 in a powerful stream 102.

Tubular shell 138, preferably made of closed-cell polyethylene foam, surrounds tubular housing 106, to provide both a soft protective surface and buoyancy. Other materials may be substituted for polyethylene foam, such as ethylene vinyl acetate closed-cell foam.

Figure 8:
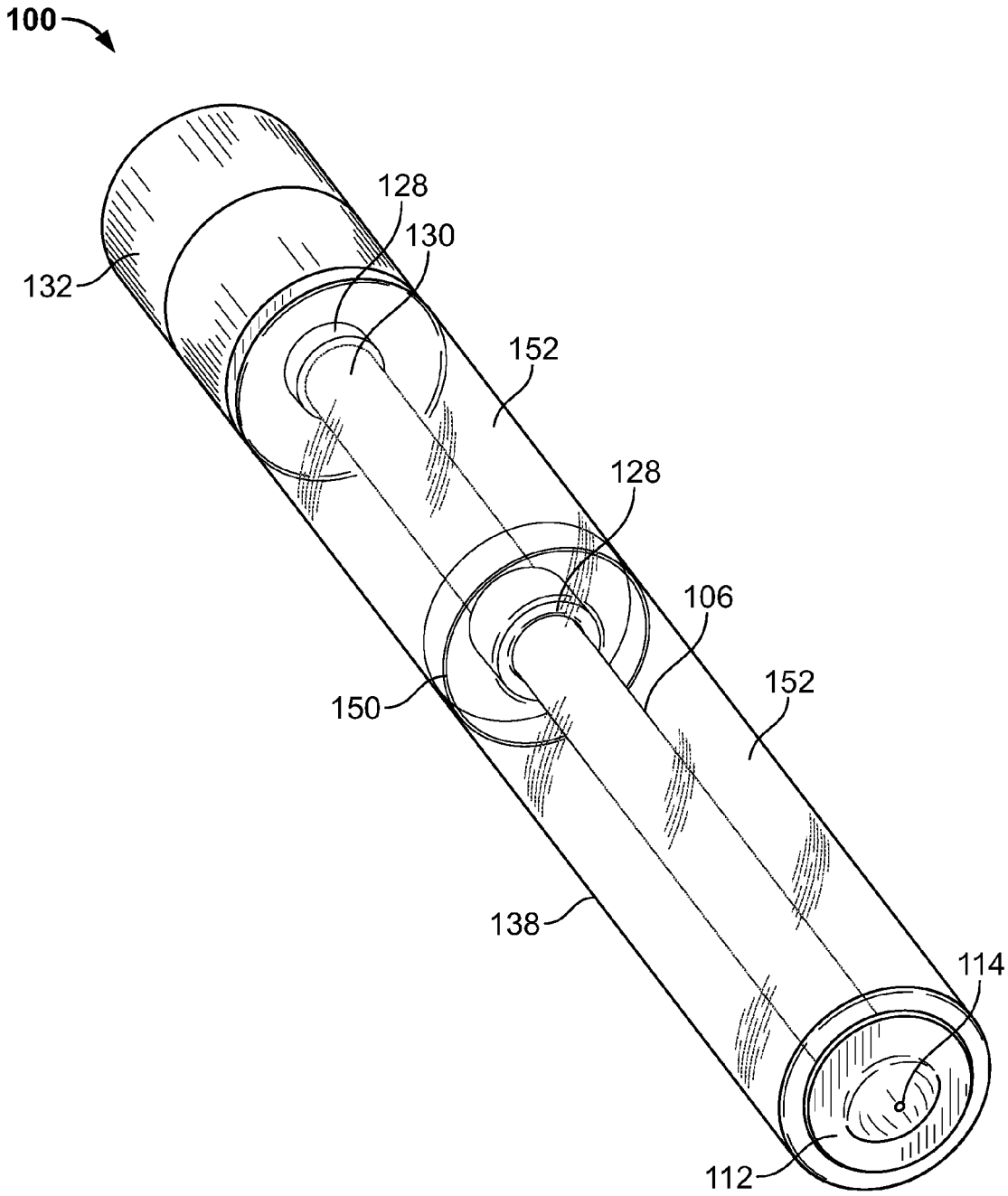
FIG. 8 is a side perspective view of an embodiment of the squirting toy of the present invention.
Figure 9:
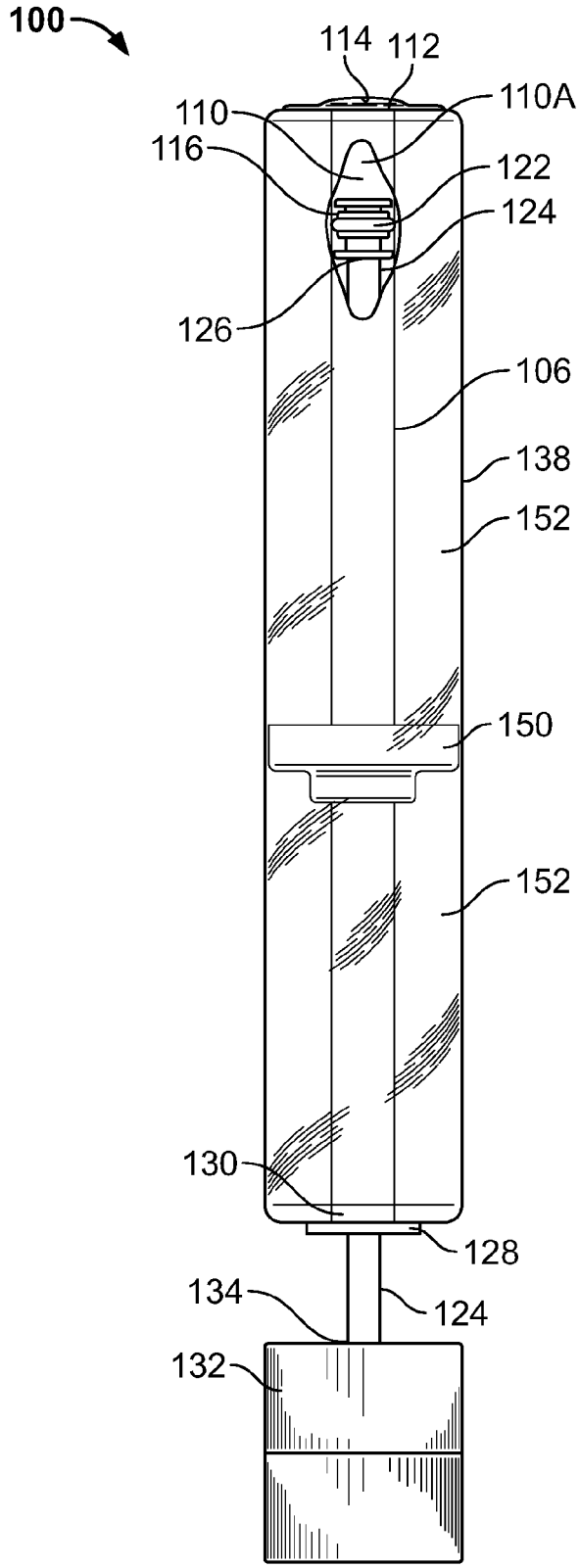
FIG. 9 is a side elevation view of the squirting toy embodiment of FIG. 8 showing a section view of tubular housing containing piston 116 and handle portion 132 separated a distance from shell 138.

FIGS. 8 and 9 show an alternative embodiment of the squirting toy invention. The encapsulating shell 138 of FIG. 9 is a thin material, e.g. a polymer, that defines a toroidal space between an inside surface of the encapsulating shell 138 and the outside surface of housing 106. Encapsulating shell 138 prevents water from entering toroidal space 152 and provides buoyancy when toy 100 is in a pool or other body or water even when housing 106 is filled with liquid.

In a most preferred embodiment, encapsulating shell 138 is formed from a material and of wall thickness to provide flexibility and 'softness' to the encapsulating shell. Examples of such materials include polyethylene terephthalate (PET or PETE), low density polyethylene (LDPE), high density polyethylene (HDPE). Materials and wall thickness parameters similar to those of standard carbonated beverage bottles will provide sufficient 'softness' to form a safe squirting toy, i.e. the toy 100 having encapsulating shell 138 of the most preferred embodiment will not injure a person hit with the toy at typical velocities. Encapsulating shell 138 may be supported at one or more points along its length by a shell support 150. Alternatively, a much thinner wall thickness may be chosen and the toroidal space slightly pressurized. Proper choice of pressure will result in encapsulating shell 138 maintaining a selected 3-dimensional shape while remaining soft enough to offer safety benefits.

In another preferred embodiment of the squirting toy, encapsulating shell 138 may be transparent, semi-transparent or translucent. Such a preferred embodiment is shown in FIGS. 8 and 9.

Handle portion 132 may include handle shell 140, which is preferable made of the same foam, and is rigidly connected shaft 124 by means of support bushings 144 and 146. Alternatively, other materials having sufficient buoyancy, softness, and water impermeability, such as polyurethane foam, may be used for both the tubular and handle shells. The shells may also be blow molded or rotationally molded air-filled cylindrical bladders or similar materials, as illustrated by encapsulating shell 32 in FIGS. 8 and 9. The handle shell 140 may also be made of solid material as long as sufficient buoyancy is provided by the tubular shell.

A most preferred embodiment of the present invention has the squirting toy emulating a "swimming noodle", well known in the context of recreational water activities. When the handle portion is retracted, as in FIG. 2, the shell 138 and handle shell 140 may form a cylinder of round, elliptical, square, polygon, oval or irregular cross-section. In a most preferred embodiment, shell 138 and handle shell 140 are of identical outside shape and are formed from closed-cell polymer foam, thus creating a similar appearance and feel to those of a common "swimming noodle". This emulated swimming noodle may be of any cross-sectional shape, e.g. round, polygonal, elliptical, oval, or some combination of shapes including generally polygonal with rounded sides.

Figure 6:
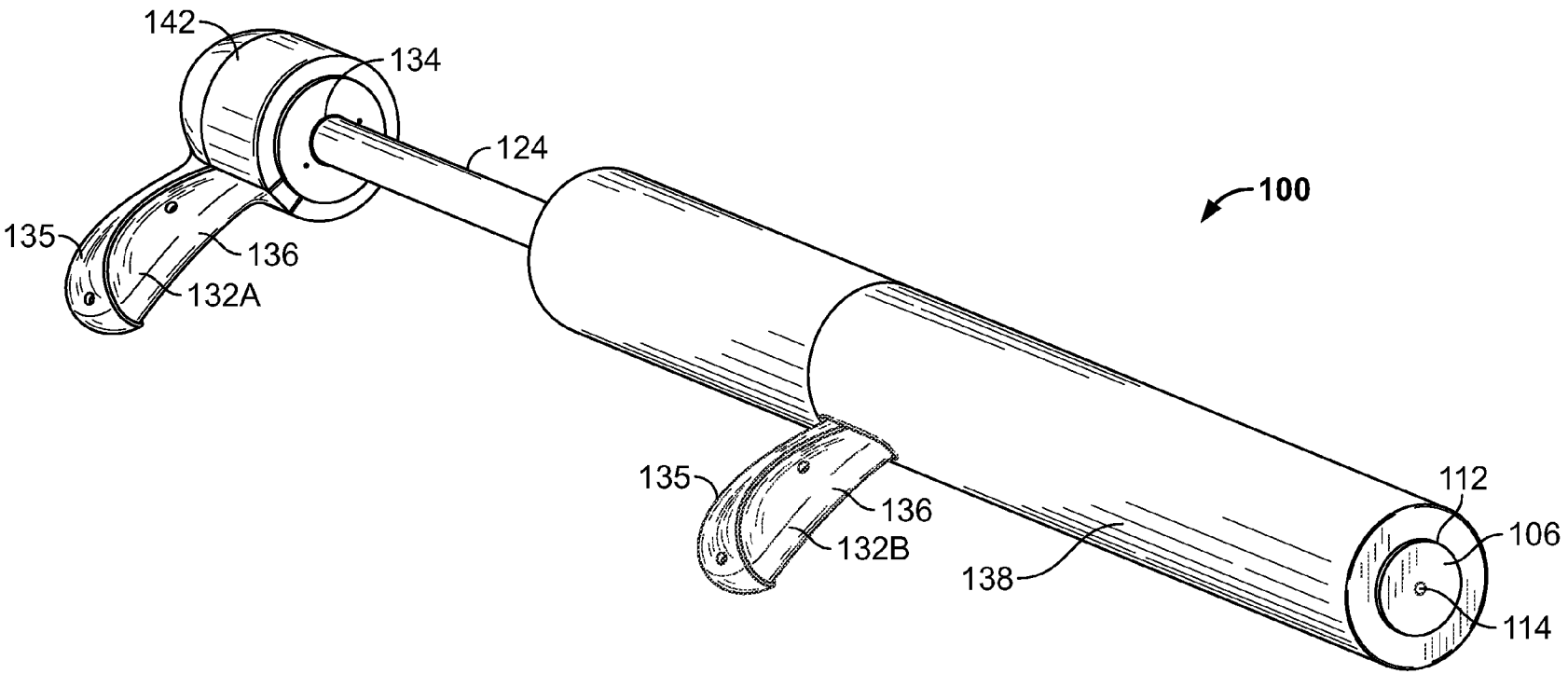
FIG. 6 is a side perspective view of an embodiment of the squirting toy of the present invention.

FIG. 6 shows an alternative embodiment of the present invention. Toy 100 comprises a housing 106 enclosing a chamber 110, the forward end 112 of the housing having a small hole 114. Piston 116 slides within and is sealed against the cylindrical inner surface 120 of the chamber 110. A shaft retainer 142 is connected to shaft 124 at the rearward end 134 thereof. Shaft retainer 142 further comprises a handle 132A. Handle 132A, in a preferred embodiment, is shaped such that it has a palm surface 135 and a finger surface 136, i.e. surfaces molded to receive respective portions of a hand. Gripping handle 132A allows a user to operate shaft 124 and piston 116 as described above.

In a more preferred embodiment, one of either the housing 106 or the shell 138 has a handle 132B extending therefrom. Handle 132B may also have a palm surface 135 and a finger surface 136. Grasping both handle 132A and 132B and forcing them away from one another while hole 114 is below the water surface 104 causes water to be inhaled into the expanding forward chamber portion 110A through hole 114. Subsequent forcing of handles 132A and 132B toward one another causes water in chamber portion 110A to be exhaled through hole 114 in a powerful stream 102.

Figure 7:
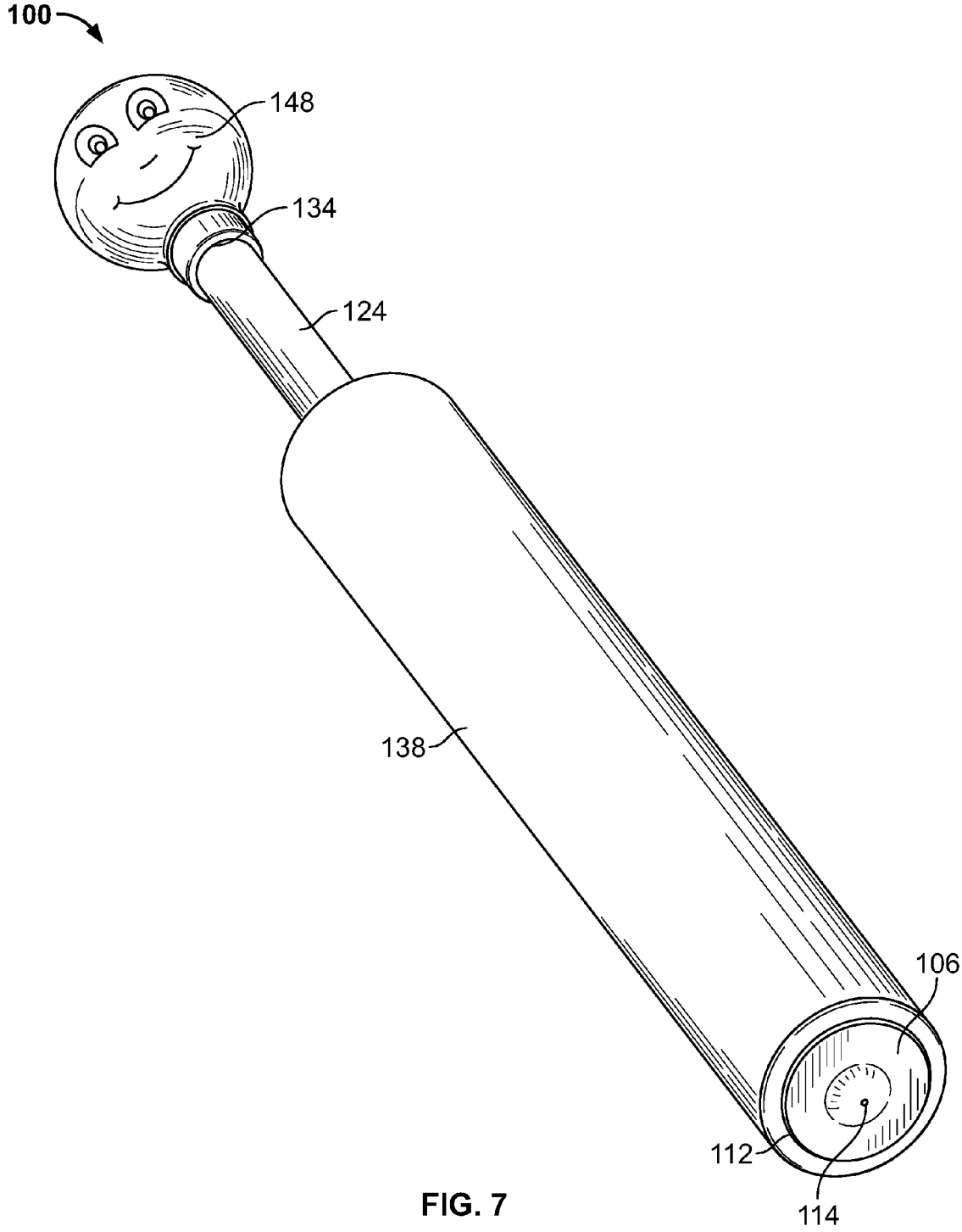
FIG. 7 is a side perspective view of an embodiment of the squirting toy of the present invention.

In another preferred embodiment of the present invention, the handle portion of squirting toy 100 may take a fanciful form. An example is shown schematically in FIG. 7. Examples of the shape of the handle 148 include: an animal head; a cartoon character head; a person's head;

It will be appreciated by those skilled in the applicable arts that the foregoing is merely one of many possible embodiments of the invention, and that the invention should therefore only be limited according to the following claims.

What is claimed:

1. A floating squirting toy, comprising:

a housing having a chamber and an opening, the opening allowing fluid communication between the chamber and the outside environment;

a shaft, supported by a slide bushing, having a first portion inside of the chamber attached to a piston and a second portion outside of the chamber attached to a handle;

the piston being adapted for longitudinal movement within the housing to decrease and increase the volume of the chamber such that water is inhaled through the opening when the volume increases and exhaled through the opening when the volume decreases; and on at least the housing, an at least one outer shell that provides safety benefits by (i) being constructed of a resilient closed-cell polymer foam material that is substantially soft, (ii) being constructed such that that the at least one outer shell imparts a buoyancy that causes the floating squirting toy to remain afloat when the chamber is completely filled with water, and (iii) being constructed such that remaining elements of the floating squirting toy do not substantially protrude beyond the at least one outer shell.

2. The floating squirting toy of claim 1, wherein the substantially soft resilient closed-cell polymer foam material is at least one of polyethylene closed-cell foam and ethylene vinyl acetate closed-cell foam.

3. The floating squirting toy of claim 1, wherein the substantially soft resilient closed-cell polymer foam material is at least one of polyethylene terephthalate, low density polyethylene, high density polyethylene.

4. The floating squirting toy of claim 1, wherein the at least one substantially soft resilient closed-cell polymer foam outer shell is constructed in a cylindrical shape.

5. The floating squirting toy of claim 4, wherein the at least one cylindrically shaped substantially soft resilient closed-cell polymer foam outer shell has a cross-sectional shape that is at least one of round, polygonal, elliptical, oval, and some combination of shapes including generally polygonal with rounded sides.

6. The floating squirting toy of claim 1, wherein the at least one substantially soft resilient closed-cell polymer foam outer shell is constructed to at least one of the size and shape of an at least one swimming noodle.

7. The floating squirting toy of claim 1, wherein the at least on substantially soft resilient closed-cell polymer foam outer shell is constructed to have a length dimension that is substantially equal to at least one of a length of the housing and a length of the handle.

8. The floating squirting toy of claim 1, wherein the remaining elements of the floating squirting toy include the housing, the chamber, the shaft, the slide bushing, the piston, and the handle.

9. The floating squirting toy of claim 8, wherein the outer dimensions of the remaining elements of the floating squirting toy are at least one of substantially equal to, slightly larger than, substantially smaller than, and slightly smaller than the at least one outer shell.

10. The floating squirting toy of claim 8, wherein the at least one outer shell provides safety benefits by being constructed such that if at least one remaining element protrudes slightly beyond the at least one outer shell, the safety benefits of the at least one outer shell are not destroyed.

11. The floating squirting toy of claim 1, wherein the at least one outer shell provides safety benefits by being constructed such that if at least one remaining element protrudes slightly beyond the at least one outer shell, the safety benefits of the at least one outer shell are not destroyed.

12. A floating squirting toy, comprising:

a housing having a chamber and an opening, the opening allowing fluid communication between the chamber and the outside environment;

a shaft, supported by a slide bushing, having a first portion inside of the chamber attached to a piston and a second portion outside of the chamber attached to a handle;

the piston being adapted for longitudinal movement within the housing to decrease and increase the volume of the chamber such that water is inhaled through the opening when the volume increases and exhaled through the opening when the volume decreases; and on at least the housing, an at least one outer shell that provides safety benefits by (i) being constructed of a resilient closed-cell polymer foam material that is substantially soft and (ii) being constructed such that that the at least one outer shell imparts a buoyancy that causes the floating squirting toy to remain afloat when the chamber is completely filled with water.

13. The floating squirting toy of claim 12, wherein the substantially soft resilient closed-cell polymer foam material is at least one of polyethylene closed-cell foam and ethylene vinyl acetate closed-cell foam.

14. The floating squirting toy of claim 12, wherein the substantially soft resilient closed-cell polymer foam material is at least one of polyethylene terephthalate, low density polyethylene, high density polyethylene.

15. The floating squirting toy of claim 12, wherein the at least one substantially soft resilient closed-cell polymer foam outer shell is constructed in a cylindrical shape.

16. The floating squirting toy of claim 15, wherein the at least one cylindrically shaped substantially soft resilient closed-cell polymer foam outer shell has a cross-sectional shape that is at least one of round, polygonal, elliptical, oval, and some combination of shapes including generally polygonal with rounded sides.

17. The floating squirting toy of claim 12, wherein the at least one substantially soft resilient closed-cell polymer foam outer shell is constructed to at least one of the size and shape of an at least one swimming noodle.

18. The floating squirting toy of claim 12, wherein the at least on substantially soft resilient closed-cell polymer foam outer shell is constructed to have a length dimension that is substantially equal to at least one of a length of the housing and a length of the handle.

19. The floating squirting toy of claim 12, wherein the at least one outer shell provides safety benefits by being constructed such that remaining elements of the floating squirting toy do not substantially protrude beyond the at least one outer shell and being constructed such that if at least one remaining element protrudes slightly beyond the at least one outer shell, the safety benefits of the at least one outer shell are not destroyed.

20. A floating squirting toy, comprising:

a housing having a chamber and an opening, the opening allowing fluid communication between the chamber and the outside environment;

a shaft, supported by a slide bushing, having a first portion inside of the chamber attached to a piston and a second portion outside of the chamber attached to a handle;

the piston being adapted for longitudinal movement within the housing to decrease and increase the volume of the chamber such that water is inhaled through the opening when the volume increases and exhaled through the opening when the volume decreases;

on at least the housing, an at least one outer shell that provides safety benefits by (i) being constructed of a resilient closed-cell polymer foam material that is substantially soft and (ii) being constructed such that that the at least one outer shell imparts a buoyancy that causes the floating squirting toy to remain afloat when the chamber is completely filled with water; and wherein longitudinal movement of the piston within the housing by the handle decrease the volume of the chamber such that water is forcibly exhaled through the opening of the housing.

21. The floating squirting toy of claim 20, wherein by applying force on the handle the piston is driven longitudinally within the housing.

22. The floating squirting toy of claim 20, wherein the piston longitudinally moves substantially the length of the housing.

23. The floating squirting toy of claim 20, wherein water is stored in the chamber of the housing when the piston is moved to increase the volume of the chamber.

* * * * *